United States Patent [19]

Dall

[11] Patent Number: 4,857,707

[45] Date of Patent: Aug. 15, 1989

[54] FLEXIBLE FRAME HEATER ELEMENT FOR DRYER

[75] Inventor: Larry N. Dall, Lincoln Township, Berrien County, Mich.

[73] Assignee: Whirlpool Corporation, Benton Harbor, Mich.

[21] Appl. No.: 180,100

[22] Filed: Apr. 11, 1988

[51] Int. Cl.[4] ..... H05B 3/64

[52] U.S. Cl. ..... 219/375; 338/210; 338/304; 219/523; 219/532

[58] Field of Search ..... 219/400, 375, 532, 523; 338/210, 304, 321

[56] References Cited

U.S. PATENT DOCUMENTS

| | | | |
|---|---|---|---|
| Re. 20,954 | 12/1938 | Kärcher | 219/523 |
| 1,997,146 | 4/1935 | Hynes | 219/534 |
| 2,226,526 | 12/1940 | Osterheld | 219/537 |
| 2,367,368 | 1/1945 | Osterheld | 219/535 |
| 2,622,181 | 12/1952 | Sheidler | 219/532 |
| 2,750,487 | 6/1956 | Hynes | 219/306 |
| 2,888,546 | 5/1959 | Kinney | 219/523 |
| 3,541,293 | 11/1970 | MacDonald | 219/406 |
| 3,860,789 | 1/1975 | Maake | 219/532 |
| 3,904,851 | 9/1975 | Gustafson | 219/374 |
| 4,019,023 | 4/1977 | Marzonie | 219/400 |
| 4,243,872 | 1/1981 | Best | 219/375 |
| 4,359,627 | 11/1982 | Takeichi | 219/523 |
| 4,472,624 | 9/1984 | Janning | 219/375 |
| 4,617,547 | 10/1986 | Howard | 219/375 |
| 4,700,495 | 10/1987 | Drews | 219/375 |

*Primary Examiner*—Teresa J. Walberg

*Attorney, Agent, or Firm*—Hill, Van Santen, Steadman & Simpson

[57] ABSTRACT

A longitudinally flexible electrical heating element for a dryer is provided which permits the heating element to be inserted into and removed from a vertical air inlet conduit located behind the dryer drum from the front of the dryer. A front panel of the dryer is removed and the heating element is inserted or removed through an inlet aperture in the air inlet conduit which opens into the interior of the cabinet.

8 Claims, 2 Drawing Sheets

FLEXIBLE FRAME HEATER ELEMENT FOR DRYER

BACKGROUND OF THE INVENTION

1. Field of the Invention

The present invention relates to automatic clothes dryers and more particularly to an electrical heating element for use in a clothes dryer.

2. Description of the Prior Art

It is customary in clothes dryers to provide a heater, such as an electrical resistance heating element in an inlet air stream in order to heat the air which is being admitted to the drying drum to speed the drying process. Conventionally and preferably, the electrical heating element is positioned in a vertical air passage so that the heat generated by the element will rise with the air flowing over the element which is then directed into the interior of the rotating drum to aid drying of the clothes load. Generally, the placement of the electrical heating element, in the vertical passage, is behind the drum, such as illustrated in U.S. Pat. No. 4,019,023, assigned to Whirlpool Corporation, the assignee of the present invention. Access to the heating element for servicing and replacement generally is provided through a removable panel on the rear of the dryer cabinet, which necessitates moving the dryer since the back side of the dryer is commonly abutted against a wall. Also, dryers are oftentimes placed side by side with automatic washers in confined locations such as closets or confined spaces between cabinets and other fixed structures such that movement of the dryer to gain access to the rear wall of the dryer for servicing components such as the heating element is at best cumbersome, difficult and time consuming.

SUMMARY OF THE INVENTION

The present invention provides a heating element which is constructed with a flexible frame to enable it to be inserted into a vertical air duct which is located behind the dryer drum, from the front side of the dryer, after removal of a removable front cabinet panel. With such a construction, the heating element can easily be removed and replaced from the front of the dryer without requiring that the dryer be moved from its installed location.

The frame of the heating element is constructed so as to be laterally rigid but longitudinaly flexible so that the element can be inserted into a bottom end of the duct in a relatively horizontal orientation, the frame then bending through a 90° turn to end up in a vertical orientation. Thus, the advantages of a vertically placed heating element are retained while the advantage of front servicability is achieved.

DETAILED DESCRIPTION OF THE PREFERRED EMBODIMENTS

Figure 1:
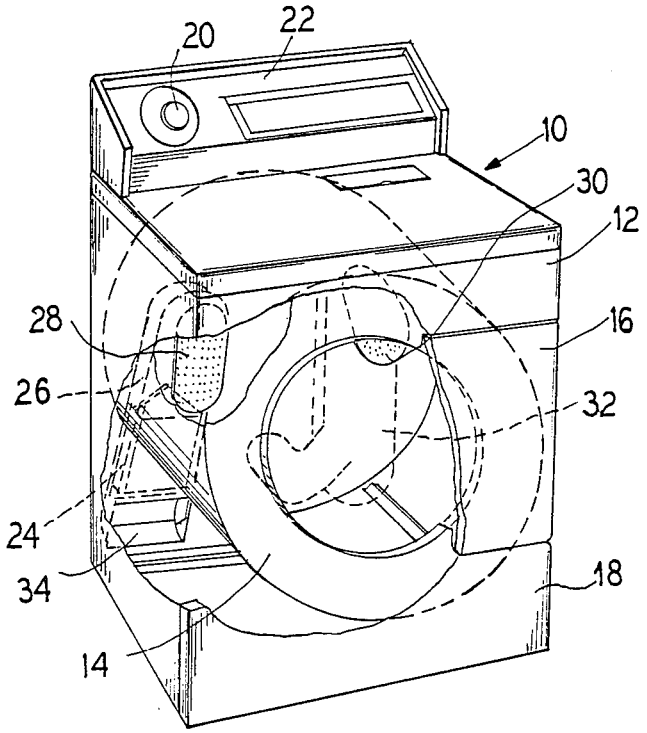
FIG. 1 is a perspective view of an automatic dryer with a heating element embodying the principles of the present invention.

In FIG. 1 there is illustrated an automatic clothes dryer generally at 10 which includes an outer cabinet 12 enclosing a rotatable drum 14 for receiving a clothes load to be dried. An openable door 16 is provided on a front wall of the cabinet 12 to provide access to the interior of the drum 14. A removable toe or kick plate 18 forms a bottom portion of the front of the dryer cabinet, removal of the toe plate 18 providing access to the interior of the cabinet 12 below the drum 14.

A control knob 20 is provided on a control console 22 located at the top rear of the cabinet 12 for selecting a preprogrammed series of drying steps including a heating step. Heat is provided by an electrical resistance heating element 24 located in a relatively vertically disposed heating duct or air inlet conduit 26 which has an inlet aperture 28 opening into the interior of the drum 14. Exhaust openings 30 are connected to an exhaust air conduit 32 and to a fan (not shown) to draw air out of the drum 14. The air inlet conduit 26 has an opening 34 which is open into an area below the dryer drum 14 and which can be accessed from the front of the dryer 10 upon removal of the toe plate 18.

Figure 2:
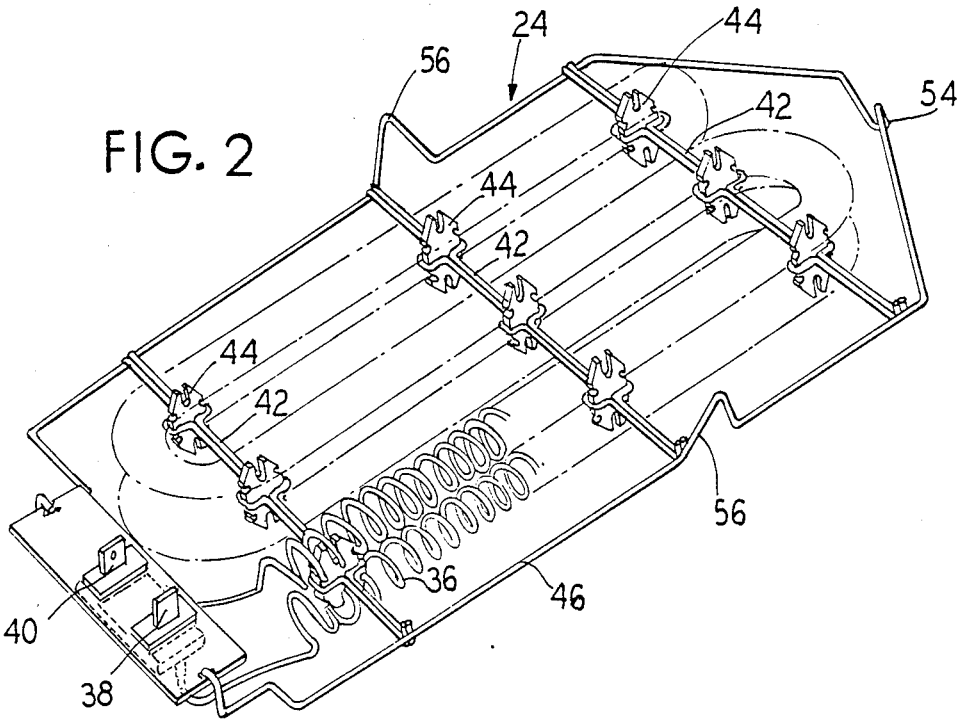
FIG. 2 is a perspective view of the heating element of FIG. 1.
Figure 3:
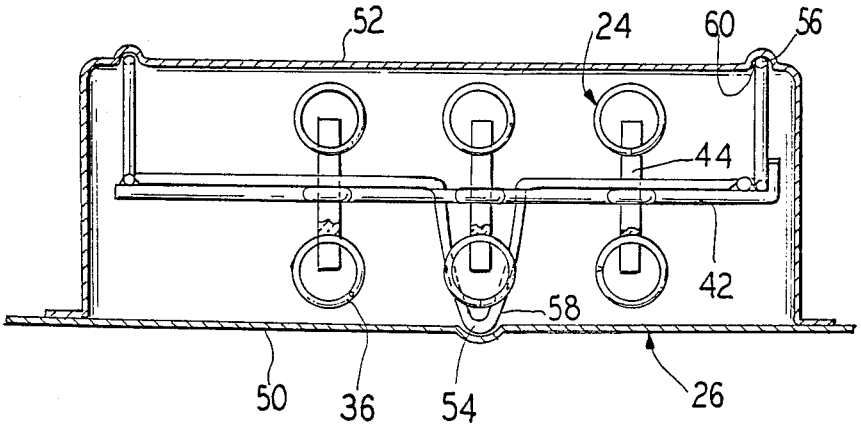
FIG. 3 is a top sectional view of the air inlet conduit duct showing the heating element in place.
Figure 4:
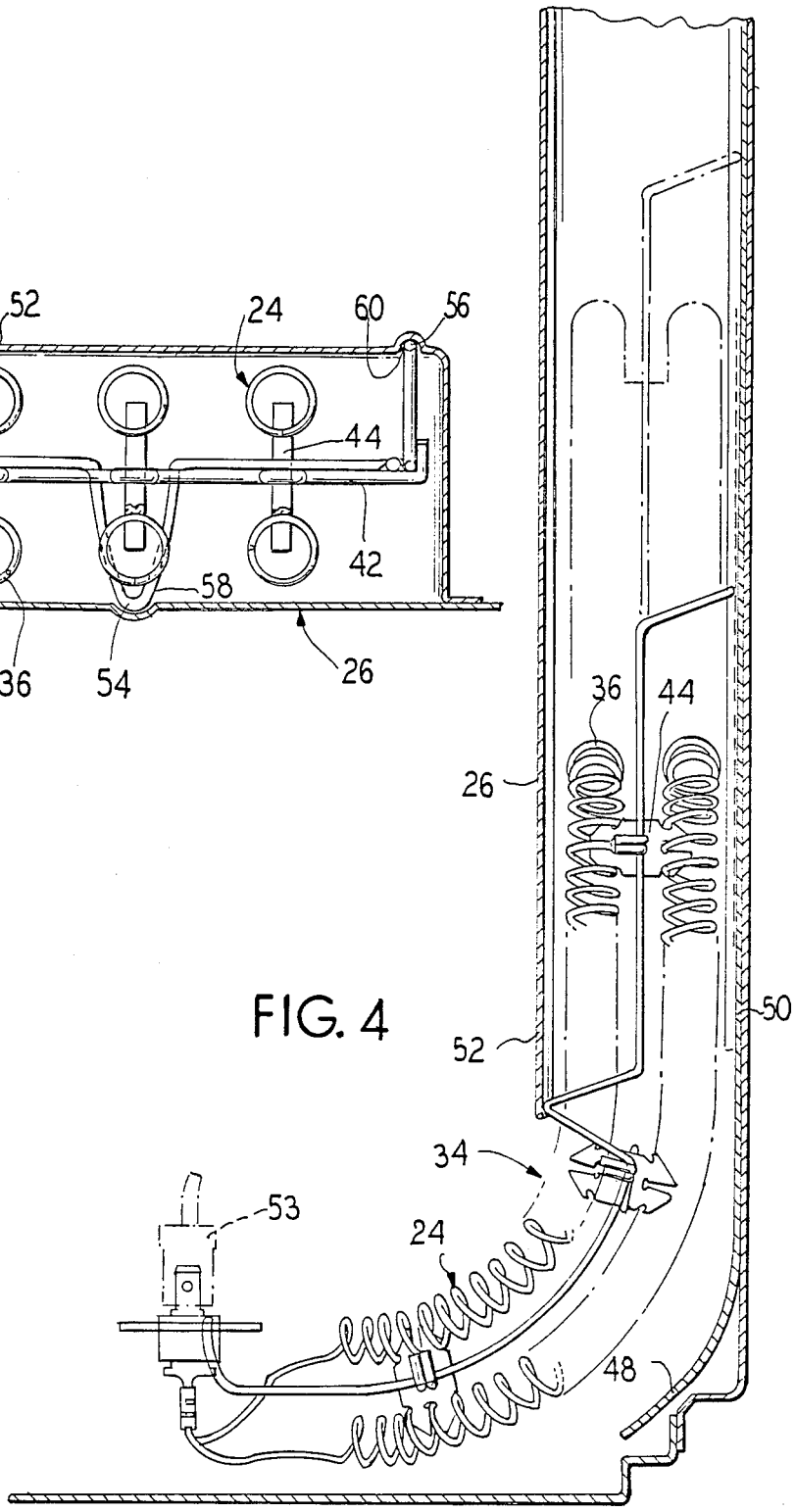
FIG. 4 is a side view illustrating the flexible heating coil frame being inserted into the air inlet conduit.

The electrical resistance heating element 24 embodying the principles of the present invention is shown in greater detail in FIGS. 2–4. The heating element comprises a continuous wire coil 36 extending from a first connection terminal 38 to a second terminal 40 in a serpentine configuration best shown in FIG. 2. Rigid lateral frame elements 42 carry insulating supports 44 which hold the coiled heating element away from the frame elements 42 to prevent shorting of the electrical current carried by the coil 36 through the frame elements. A continuous perimeter or longitudinal frame element 46 interconnects the lateral ends of the lateral frame elements 42 and furthermore extends longitudinally beyond the coiled heating element 36 to completely surround the heating element and support the terminals 38 and 40. The longitudinal frame element 46 is preferably constructed of a metallic wire of a sufficiently light gauge to permit the frame element 46 to bend or flex along its longitudinal length about an axis running laterally relative to the frame and parallel to the lateral frame elements while the lateral frame elements 42 are comparatively rigid such as to hold the frame laterally rigid and prevent bending about a longitudinal axis. The longitudinal frame element 46 should be sufficiently rigid so as to normally prevent flexure of the frame, but should also be sufficiently flexible so as to permit flexure of the frame upon application of a manual force, such as is imparted by a person inserting the frame into a curved guide.

The bending of the longitudinal frame element 46 during installation or servicing is illustrated in FIG. 4. The air inlet conduit 26 has a rear wall 50 having a forwardly curved bottom end 48 and a front wall 52 which terminates above the bottom end 48 of the rear wall to define therebetween the inlet aperture 34 into which the heating element 24 can be inserted. The curved bottom end 48 of the rear wall 50 assists the heating element in making the transition from a horizontal orientation, as it is being manually inserted into the opening 34, into a vertical orientation, in its final installed position within the inlet air duct 26. The terminals 38 and 40 remain exposed at the opening 34 when the heating element is in the installed position to permit easy connection and disconnection of the heating element terminals to and from wires 53 leading to the control circuitry, well known in the art, in the console 22.

The frame element 46 may include various bend locations such as at a forward end 54 in which the bend may form a bight directed downwardly (horizontal orientation of FIGS. 2 and 3) or rearwardly (vertical orientation of FIGS. 1 and 4) and, a pair of bends 56 located on the longitudinally extending side portions of the frame element 46 which are directed upwardly (horizontal orientation) or forwardly (vertical orientation). As seen in FIG. 3, these bend portions 54 and 56 may engage in guide channels 58 and 60, respectively, formed in the inlet duct 26 to assist in guiding the heating element 24 into the inlet air conduit 26. The bend portions 54 and 56 also assist in spacing the wire coil 36 away from the walls 50 and 52 of the inlet air conduit 26 to prevent a shorting of the coils through the walls of the air inlet conduit.

Although the longitudinal frame element 46 has been depicted as being formed of a light gauge metallic wire, it is also contemplated by the present invention that the longitudinal frame element 46 be constructed of any material or in any manner so as to permit longitudinal bending of the frame element about a lateral axis parallel to the lateral frame elements members 42. Similarly, the lateral frame elements 42 may be constructed in any manner so as to inhibit lateral bending of the frame element about a longitudinal axis normal to the lateral frame elements 42.

Thus, the invention provides an electrical heating element which can be easily inserted into a vertical air inlet conduit located behind the dryer drum by merely removing a front panel from the dryer cabinet and inserting the heating element through an inlet aperture of the air inlet opening into the interior of the cabinet.

As is apparent from the foregoing specification, the invention is susceptible of being embodied with various alterations and modifications which may differ particularly from those that have been described in the preceeding specification and description without departing from the spirit of the invention. It should be understood that I wish to include within the scope of the patent warranted hereon all such modifications as reasonably and properly come within the scope of my contribution to the art.

The embodiments of the invention in which an exclusive property or privilege is claimed are defined as follows:

1. A heater element for a dryer comprising:

a flexible electrical heating means;

a plurality of rigid wire form lateral frame elements;

a plurality of support members securing said heating means to said lateral frame elements;

at least one flexible wire form frame element longitudinally interconnecting said lateral frame elements at the lateral ends of said lateral frame elements and forming a perimeter of said heater element;

said flexible frame element being sufficiently rigid so as to normally prevent flexure of said frame element, but being sufficiently flexible so as to permit flexure of said frame element upon application of a predetermined manual force.

2. A heater element according to claim 1, wherein said flexible frame element extends longitudinally beyond said lateral frame elements.

3. A heater element according to claim 1, wherein said flexible frame element is fabricated of a light gauge metallic wire.

4. A heater element according to claim 1 wherein said heater element includes a housing for said heating means having at least one guide channel formed therein and said flexible frame means includes at least one guide means for engaging with said guide channel.

5. A heater element according to claim 4, wherein said guide channel is arcuate along a portion of its length and said flexible frame element is sufficiently flexible to follow the curve of the channel upon insertion of the flexible frame element into the housing.

6. A heater element for a dryer comprising:

a flexible electrical heating means;

a plurality of rigid wire form lateral frame elements;

a plurality of support members securing said heating means to said lateral frame elements;

at least one flexible wire form frame element fabricated of a light gauge metallic wire longitudinally interconnecting said lateral frame elements at the lateral ends of said lateral frame elements, extending longitudinally beyond said lateral frame elements and forming a perimeter of said heater element;

said flexible frame element being sufficiently rigid so as to normally prevent flexure of said frame element, but being sufficiently flexible so as to permit flexure of said frame element up application of a predetermined manual force.

7. A heater element according to claim 6, wherein said heater element includes a housing for said heating means having at least one guide channel formed therein and said flexible frame means includes at least one guide means for engaging with said guide channel.

8. A heater element according to claim 7, wherein said guide channel is arcuate along a portion of its length and said flexible frame element is sufficiently flexible to follow the curve of the channel upon insertion of the flexible frame element into the housing.

* * * * *